US010927320B2

(12) United States Patent
Ali et al.

(10) Patent No.: US 10,927,320 B2
(45) Date of Patent: Feb. 23, 2021

(54) ADDITISING A FUEL

(71) Applicant: BP OIL INTERNATIONAL LIMITED, Middlesex (GB)

(72) Inventors: Rana Ali, Reading (GB); Sorin Vasile Filip, Reading (GB); Brian Edward Macey, Reading (GB); John Stuart Rogerson, Reading (GB)

(73) Assignee: BP OIL INTERNATIONAL LIMITED, Middlesex (GB)

( * ) Notice: Subject to any disclaimer, the term of this patent is extended or adjusted under 35 U.S.C. 154(b) by 0 days.

(21) Appl. No.: 16/077,450

(22) PCT Filed: Feb. 9, 2017

(86) PCT No.: PCT/EP2017/052926
§ 371 (c)(1),
(2) Date: Aug. 11, 2018

(87) PCT Pub. No.: WO2017/137516
PCT Pub. Date: Aug. 17, 2017

(65) Prior Publication Data

US 2019/0040331 A1 Feb. 7, 2019

(30) Foreign Application Priority Data

Feb. 11, 2016 (EP) ..... 16155208

(51) Int. Cl.
*C10L 10/10* (2006.01)
*C10L 1/02* (2006.01)
*C10L 1/233* (2006.01)

(52) U.S. Cl.
CPC ..... *C10L 10/10* (2013.01); *C10L 1/023* (2013.01); *C10L 1/233* (2013.01); *C10L 1/2335* (2013.01); *C10L 2200/0423* (2013.01); *C10L 2270/023* (2013.01); *C10L 2290/24* (2013.01)

(58) Field of Classification Search
CPC combination set(s) only.
See application file for complete search history.

(56) References Cited

U.S. PATENT DOCUMENTS

2007/0204505 A1* 9/2007 Abou-Nemeh ..... C10L 1/14 44/333
2010/0269404 A1* 10/2010 Sloan ..... C10L 1/14 44/370

FOREIGN PATENT DOCUMENTS

GB 2308849 A * 7/1997 ..... C10L 10/10
GB 2308849 A 7/1997
WO 2005/087901 A2 9/2005

OTHER PUBLICATIONS

International Search Report and Written Opinion of the International Search Authority for International Application No. PCT/EP2017/052926, dated Apr. 4, 2017.
Search Report for EP 16155208.8, dated Jun. 20, 2016.

* cited by examiner

*Primary Examiner* — Ellen M McAvoy
*Assistant Examiner* — Chantel L Graham
(74) *Attorney, Agent, or Firm* — McDonnell Boehnen Hulbert & Berghoff LLP

(57) ABSTRACT

A method for preparing a fuel composition which comprises a base fuel, an oxygenate and an octane-boosting additive comprises: blending an additised oxygenate with a base fuel, wherein the additised oxygenate comprises an oxygenate and an octane-boosting additive. The method enables suitable amounts of octane-boosting additives to be incorporated into a fuel composition, whilst enabling fuels having a range of properties to be prepared.

20 Claims, 3 Drawing Sheets

ADDITISING A FUEL

This application is a national stage application under 35 U.S.C. § 371 of International Application No. PCT/EP2017/052926, filed Feb. 9, 2017, which claims priority to European Patent Application No. EP 16155208.8, filed Feb. 11, 2016, the disclosures of which are explicitly incorporated by reference herein.

FIELD OF THE INVENTION

This invention relates to a method for additising a fuel. In particular, the invention relates to a method for additising a fuel for a spark-ignition internal combustion engine with a non-metallic octane-boosting additive.

BACKGROUND OF THE INVENTION

Spark-ignition internal combustion engines are widely used for power, both domestically and in industry. For instance, spark-ignition internal combustion engines are commonly used to power vehicles, such as passenger cars, in the automotive industry.

In many regions, the addition of oxygenates, such as alcohols, into fuels for automotive spark-ignition internal combustion engines is mandatory or influenced by fiscal initiatives. Methanol and bio-derived ethanol are common oxygenates that are added to fuels to comply with regional regulatory quotas. The oxygenates that are added to fuels are also usually required to meet regional specifications. For instance, in the European Union, ethanol must meet the requirements of EN 15376:2014.

Some oxygenates are not compatible with conventional multi-fuel pipeline distribution systems. For example, ethanol is very soluble in water and in multi-fuel pipelines can also cause water contamination of other fuels that share the pipeline. Therefore, such oxygenates are not blended into the fuel at the refinery, but are generally kept in tanks and mixed with a gasoline intermediate fuel (known as a Blendstock for Oxygenate Blending; "BOB") at fuel terminals. A BOB is typically a hydrocarbon-based blendstock which is produced by petroleum refineries and distributed to fuel terminals. The BOB is usually blended in a way which ensures that the distillation profile, octane characteristics and vapour pressure of the oxygenate blended fuel will meet the required regional standards.

Standard performance and stability enhancing additives (collectively referred to as fuel additives) may also be added at the fuel terminal, and the resulting gasoline fuel transported to the retail distribution network, e.g. by road trucks or rail trucks. Common fuel additives include, e.g., anti-fouling additives such as deposit control/clean-up agents, anti-oxidants, corrosion inhibitors and friction modifiers. In certain regions, octane improver additives are also added to the fuel. However, octane improvers are not commonly part of a formulated additive pack as additive packs are primarily used in deposit control and stability.

Octane improvers can be used to prevent 'knock', a phenomenon which is caused when the end gas, typically understood to be the unburnt gas between the flame front and combustion chamber walls/piston, ignites spontaneously and burns rapidly and prematurely ahead of the flame front in the combustion chamber, causing the pressure in the cylinder to rise sharply. This creates the characteristic knocking or pinking sound and is known as "knock", "detonation" or "pinking" Gasoline fuels are now required to meet regional and marketing specifications for minimum octane number, and this has led to a demand for octane boosting additives.

Organometallic compounds, comprising e.g. iron, lead or manganese, are well-known octane improvers, with tetraethyl lead (TEL) having been extensively used as a highly effective octane improver. Further examples of organometallic octane improvers include methylcyclopentadienyl manganese tricarbonyl (MMT) and ferrocene, a compound with the formula $Fe(C_5H_5)_2$. Aside from oxygenates, octane improvers which are not based on metals include alkylates and aromatic amines, such as N-methyl aniline (NMA). Unfortunately, many of the existing effective octane improvers can only be used in fuels in small amounts, if at all, as they can be toxic, damaging to the engine and damaging to the environment. Octane improvers are therefore increasingly subject to regional restrictions and even prohibitions.

Fuel additives for a fully formulated oxygenated fuel are typically added to the BOB, or the blend of oxygenate and BOB (hereinafter referred to as the oxygenate base fuel), at the fuel terminal. Usually, the additives are introduced into the fuel by additive dosing systems just before the fully formulated fuel enters the delivery vehicle (typically a road fuel tanker). This enables different fully formulated fuels to be introduced into each delivery vehicle.

However, the quantity of fuel additives that may be introduced into the fuel in this way is limited. This is because additive dosing systems are normally tuned so as to accurately dispense fuel additives at a treat rate of from 100 ppm to about 1500 ppm, which covers the vast majority of commercial additives, including deposit-controlling additive packs that are used in fuels for gasoline passenger cars. This means that fuel additives that are used at higher treat rates, such as non-metallic octane improvers (typically used in a fuel in an amount of greater than 3000 ppm, i.e. 0.3%, weight additive/weight oxygenate base fuel), may not be introduced into oxygenate fuels in adequate amounts by direct dosing into the oxygenate base fuel at the fuel terminal. Furthermore, modifying the additive dosing systems so an additive may introduced into the oxygenate base fuel at higher treat rates may compromise the dispensing accuracy for the conventional deposit-control additive packs which are used at lower treat rates.

There is also limited flexibility associated with adding the octane improver additives to the BOB, or the oxygenate base fuel at the fuel terminal. For instance, it is difficult to alter the ratio of oxygenate and octane improver, so producing fuels with different oxygenate content but the same octane grade can be challenging. Similarly, the opportunity to offer multiple octane grades with a choice of oxygenate levels is missed.

Accordingly, there remains a need for a method for additising an oxygenate-containing fuel at a fuel terminal, e.g. with an octane improver, which mitigates at least some of the problems highlighted above. In particular, there remains a need for a method for additising an oxygenate fuel, such as an ethanol-containing fuel, with adequate amounts of fuel additives, e.g. octane improvers. There also remains a need for a method for additising an oxygenate fuel, such as an ethanol-containing fuel, which enables fuels having a range of properties to be prepared.

SUMMARY OF THE INVENTION

Surprisingly, it has now been found that many of the constraints associated with additising a fuel with an octane-boosting additive may be avoided by preparing an additised oxygenate which comprises an oxygenate and an octane-boosting additive, and then blending said additised oxygenate with a base fuel.

Accordingly, the present invention provides a method for preparing a fuel composition which comprises a base fuel, an oxygenate and an octane-boosting additive, said method comprising:

blending an additised oxygenate with a base fuel, wherein the additised oxygenate comprises an oxygenate and an octane-boosting additive.

A fuel composition which is obtainable by such methods is also provided.

The present invention also provides an apparatus comprising:

a base fuel source, an oxygenate source and an octane-boosting additive source;

an oxygenate blending point through which an octane-boosting additive from the octane-boosting additive source may be blended with an oxygenate from the oxygenate source to form an additised oxygenate; and a fuel blending point through which the additised oxygenate may be blended with a base fuel from the base fuel source.

The present invention further provides an additised oxygenate, wherein the additised oxygenate comprises an oxygenate and an octane-boosting additive. Also provided is a method for producing an additised oxygenate, said method comprising blending an octane-boosting additive with an oxygenate.

BRIEF DESCRIPTION OF THE FIGURES

FIG. 3*a* shows a graph of the change in octane number of an E10 fuel against treat rate; and FIG. 3*b* shows a graph of the change in octane number of an E10 fuel at a treat rate of 0.67% by weight.

DETAILED DESCRIPTION OF THE INVENTION

Method of Preparing a Fuel Composition

Figure 1:
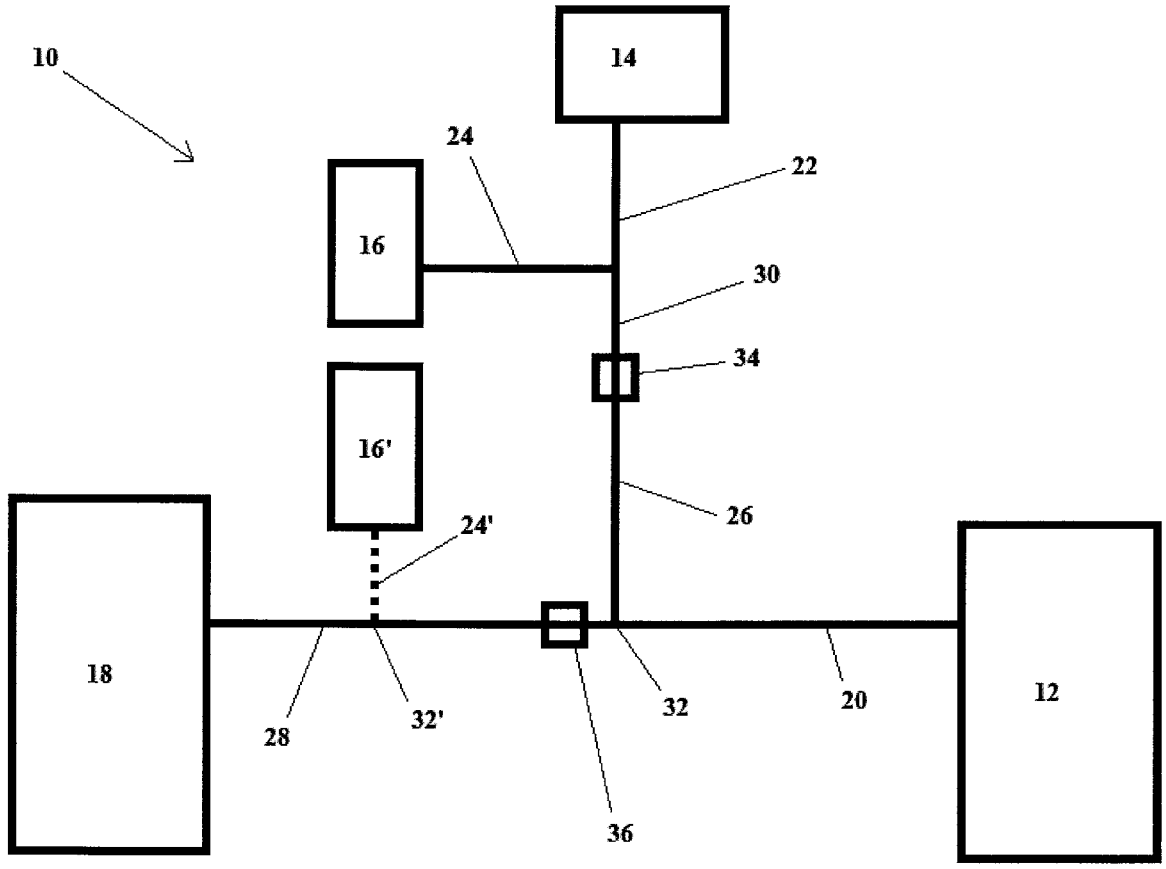
FIG. 1 is a diagram of an apparatus that may be used to carry out the method of the present invention.

The present invention provides a method for preparing a fuel composition which comprises a base fuel, an oxygenate and an octane-boosting additive. The method comprises blending an additised oxygenate with a base fuel, the additised oxygenate comprising an oxygenate and an octane-boosting additive.

Preferably, the method of the present invention further comprises producing the additised oxygenate by blending the octane-boosting additive with the oxygenate. This may be achieved by adding the octane-boosting additive to an oxygenate storage tank or to an oxygenate stream which leads to a fuel blending point through which the additised oxygenate may be blended with the base fuel. Preferably, the octane-boosting additive is added to an oxygenate stream which leads to a fuel blending point through which the additised oxygenate may be blended with the base fuel.

To ensure good distribution of the octane-boosting additive in the oxygenate, the additised oxygenate may be passed through a mixing device before it is blended with the base fuel. Similarly, to ensure good distribution of the additised oxygenate in the base fuel, the fuel composition may be passed through a mixing valve.

By using a method of the present invention, a single base fuel (such as a Blendstock for Oxygenate Blending) may be used to prepare fuel compositions having a wide range of different properties. Accordingly, in an embodiment, the method comprises preparing at least two fuels, such as at least four or six fuels, each of the fuels having a different ethanol grade and/or octane number grade.

In a particular embodiment, the method comprises blending an octane-boosting additive with an oxygenate to produce a first additised oxygenate, and blending the first additised oxygenate with a base fuel to produce a first fuel composition; and blending the octane-boosting additive with the oxygenate to produce a second additised oxygenate, and blending the second additised oxygenate with the base fuel to produce a second fuel composition; wherein the first and second fuel compositions comprise the same amount of oxygenate but have a different octane number, or the first and second fuel compositions comprise a different amount of oxygenate but have the same octane number. Where e.g. the oxygenate content in the blended fuel is reduced, but with no loss of octane, the volumetric energy density of the fuel improves, thereby providing the user with a fuel economy benefit.

Oxygenate

The oxygenate that is used in the present invention is preferably suitable for use in a spark-ignition internal combustion engine. Examples of suitable oxygenates include alcohols and ethers. Preferred oxygenates are mono-alcohols or mono-ethers with a final boiling point of up to 225° C., more preferably a mono alcohol containing less than six, more preferably less than five, carbon atoms, e.g. methanol, ethanol, n-propanol, n-butanol, isobutanol, tert-butanol. Preferably, the oxygenate is methanol, ethanol or butanol, and more preferably ethanol.

Ethers are less preferred, though they may also be used. Suitable ethers include ethers having 5 or more carbon atoms, e.g. methyl tert-butyl ether and ethyl tert-butyl ether.

In some preferred embodiments, the fuel composition comprises ethanol, e.g. ethanol complying with EN 15376: 2014.

The oxygenate may be introduced into fuel composition in amount so that the fuel composition meets particular automotive industry standards. For instance, the fuel composition may have a maximum oxygen content of 2.7% by mass. The fuel composition may have maximum amounts of oxygenates as specified in EN 228, e.g. methanol: 3.0% by volume, ethanol: 5.0% by volume, iso-propanol: 10.0% by volume, iso-butyl alcohol: 10.0% by volume, tert-butanol: 7.0% by volume, ethers (e.g. having 5 or more carbon atoms): 10% by volume and other oxygenates (subject to suitable final boiling point): 10.0% by volume.

The oxygenate is preferably added into the fuel composition so that the fuel composition comprises the oxygenate in an amount of up to 85%, preferably from 1% to 30%, more preferably from 3% to 20%, and even more preferably from 5% to 15%, by volume. For instance, the fuel composition may contain ethanol in an amount of about 5% by volume (i.e. an E5 fuel), about 10% by volume (i.e. an E10 fuel) or about 15% by volume (i.e. an E15 fuel).

It will be appreciated that, when more than one oxygenate is used, these values refer to the total amount of oxygenate that may be present in the fuel composition.

Octane-Boosting Additive

The octane-boosting additive that is used in the present invention is preferably a non-metallic octane-boosting additive. Preferred additives consist solely of C, H, N and O atoms, with the number of N atoms limited to two, and preferably one per molecule of octane-boosting additive.

The non-metallic octane-boosting additive may have a molecular weight of less than 300, preferably less than 250, and more preferably less than 200 g/mole.

The octane-boosting additive may have a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon (referred to in short as an octane-boosting additive described herein). As will be appreciated, the 6- or 7-membered heterocyclic ring sharing two adjacent aromatic carbon atoms with the 6-membered aromatic ring may be considered saturated but for those two shared carbon atoms, and may thus be termed "otherwise saturated."

Alternatively stated, the octane-boosting additive used in the present invention may be a substituted or unsubstituted 3,4-dihydro-2H-benzo[b][1,4]oxazine (also known as benzomorpholine), or a substituted or unsubstituted 2,3,4,5-tetrahydro-1,5-benzoxazepine. In other words, the additive may be 3,4-dihydro-2H-benzo[b][1,4]oxazine or a derivative thereof, or 2,3,4,5-tetrahydro-1,5-benzoxazepine or a derivative thereof. Accordingly, the additive may comprise one or more substituents and is not particularly limited in relation to the number or identity of such substituents.

Highly preferred additives have the following formula:

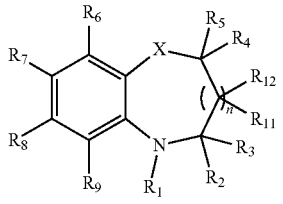

where:

$R_1$ is hydrogen;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1.

In some embodiments, $R_2$, $R_3$, $R_4$, $R_5$, $R_{11}$ and $R_{12}$ are each independently selected from hydrogen and alkyl groups, and preferably from hydrogen, methyl, ethyl, propyl and butyl groups. More preferably, $R_2$, $R_3$, $R_4$, $R_5$, $R_{11}$ and $R_{12}$ are each independently selected from hydrogen, methyl and ethyl, and even more preferably from hydrogen and methyl.

In some embodiments, $R_6$, $R_7$, $R_8$ and $R_9$ are each independently selected from hydrogen, alkyl and alkoxy groups, and preferably from hydrogen, methyl, ethyl, propyl, butyl, methoxy, ethoxy and propoxy groups. More preferably, $R_6$, $R_7$, $R_8$ and $R_9$ are each independently selected from hydrogen, methyl, ethyl and methoxy, and even more preferably from hydrogen, methyl and methoxy.

Advantageously, at least one of $R_2$, $R_3$, $R_4$, $R_5$, $R_6$, $R_7$, $R_8$, $R_9$, $R_{11}$ and $R_{12}$, and preferably at least one of $R_6$, $R_7$, $R_8$ and $R_9$, is selected from a group other than hydrogen. More preferably, at least one of $R_7$ and $R_8$ is selected from a group other than hydrogen. Alternatively stated, the octane-boosting additive may be substituted in at least one of the positions represented by $R_2$, $R_3$, $R_4$, $R_5$, $R_6$, $R_7$, $R_8$, $R_9$, $R_{11}$ and $R_{12}$, preferably in at least one of the positions represented by $R_6$, $R_7$, $R_8$ and $R_9$, and more preferably in at least one of the positions represented by $R_7$ and $R_8$. It is believed that the presence of at least one group other than hydrogen may improve the solubility of the octane-boosting additives in a fuel, though the presence of ethanol is also believed to improve the solubility of the octane-boosting additives described herein in the fuel.

Also advantageously, no more than five, preferably no more than three, and more preferably no more than two, of $R_2$, $R_3$, $R_4$, $R_5$, $R_6$, $R_7$, $R_8$, $R_9$, $R_{11}$ and $R_{12}$ are selected from a group other than hydrogen. Preferably, one or two of $R_2$, $R_3$, $R_4$, $R_5$, $R_6$, $R_7$, $R_8$, $R_9$, $R_{11}$ and $R_{12}$ are selected from a group other than hydrogen. In some embodiments, only one of $R_2$, $R_3$, $R_4$, $R_5$, $R_6$, $R_7$, $R_8$, $R_9$, $R_{11}$ and $R_{12}$ is selected from a group other than hydrogen.

It is also preferred that at least one of $R_2$ and $R_3$ is hydrogen, and more preferred that both of $R_2$ and $R_3$ are hydrogen.

In preferred embodiments, at least one of $R_4$, $R_5$, $R_7$ and $R_8$ is selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ are selected from methyl, ethyl, propyl and butyl groups and the remainder of $R_2$, $R_3$, $R_4$, $R_5$, $R_6$, $R_7$, $R_8$, $R_9$, $R_{11}$ and $R_{12}$ are hydrogen.

In further preferred embodiments, at least one of $R_4$, $R_5$, $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen. More preferably, at least one of $R_7$ and $R_8$ is a methyl group and the remainder of $R_2$, $R_3$, $R_4$, $R_5$, $R_6$, $R_7$, $R_8$, $R_9$, $R_{11}$ and $R_{12}$ are hydrogen.

Preferably, X is —O— or —$NR_{10}$—, where $R_{10}$ is selected from hydrogen, methyl, ethyl, propyl and butyl groups, and preferably from hydrogen, methyl and ethyl groups. More preferably, $R_{10}$ is hydrogen. In preferred embodiments, X is —O—.

n may be 0 or 1, though it is preferred that n is 0.

Octane-boosting additives that may be used in the present invention include:

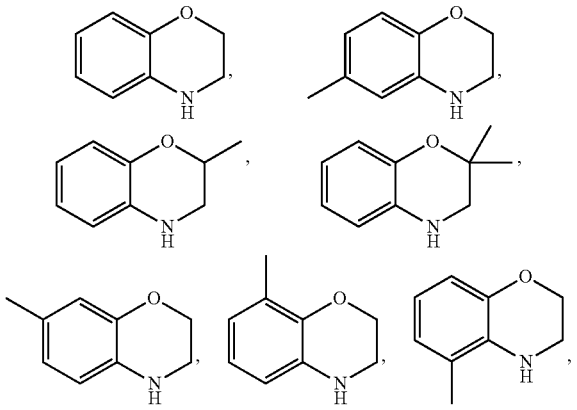

-continued

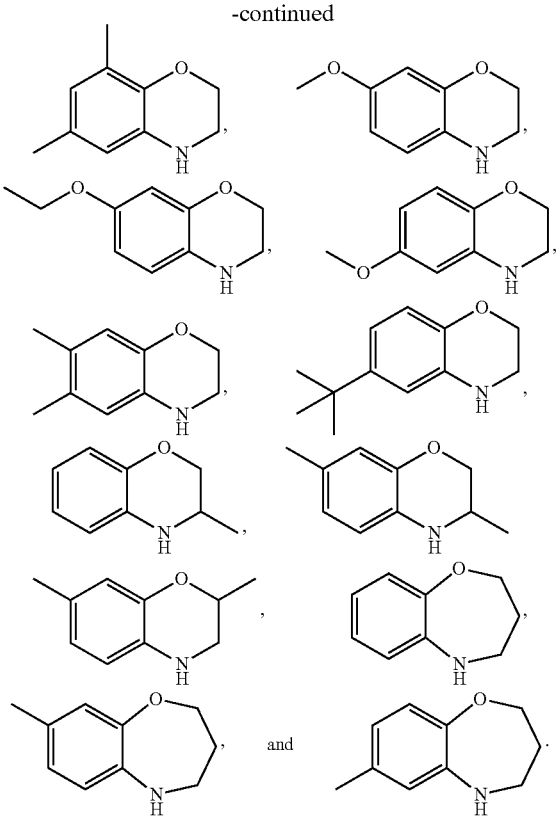

Preferred octane-boosting additives include:

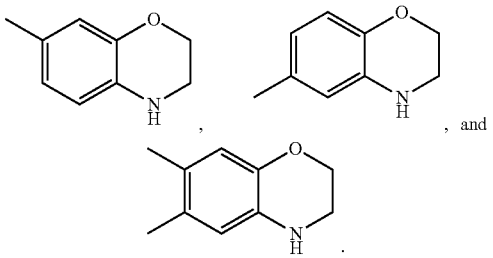

A mixture of additives may be used in the fuel composition. For instance, the fuel composition may comprise a mixture of:

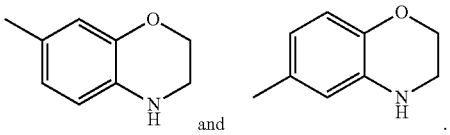

It will be appreciated that references to alkyl groups include different isomers of the alkyl group. For instance, references to propyl groups embrace n-propyl and i-propyl groups, and references to butyl embrace n-butyl, isobutyl, sec-butyl and tert-butyl groups.

The octane-boosting additive may be added to the oxygenate with one or more further additives and/or solvent (e.g. those detailed below) in the form of an additive composition. However, it is preferred that the octane-boosting additive is used in the form of an additive concentrate, optionally comprising solvent or diluent (e.g. those detailed below).

The octane-boosting additive may be introduced into fuel composition in an amount of up to 20%, preferably from 0.1% to 10%, and more preferably from 0.2% to 5% weight additive/weight base fuel. Even more preferably, the octane-boosting additive is introduced into the fuel composition in an amount of from 0.25% to 2%, and even more preferably still from 0.3% to 1% weight additive/weight base fuel. It will be appreciated that, when more than one octane-boosting additive is used, these values refer to the total amount of octane-boosting additive in the fuel.

It will be appreciated that the octane-boosting additives described herein may be used in the form of a precursor compound which, under the combustion conditions encountered in an engine, breaks down to form an octane-boosting additive as defined herein.

Base Fuel

The fuel compositions preferably comprise a major amount (i.e. greater than 50% by weight) of liquid fuel ("base fuel") and a minor amount (i.e. less than 50% by weight) of octane-boosting additive, e.g. octane-boosting additive described herein, i.e. an additive having a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon.

Examples of suitable liquid base fuels include hydrocarbon base fuels, oxygenate base fuels and combinations thereof. It will be appreciated that, although oxygenate components are added to the base fuel, the base fuel itself may also be an oxygenate base fuel. Preferably, the base fuel is a blendstock for oxygenate blending.

Hydrocarbon base fuels that may be used in a spark-ignition internal combustion engine may be derived from mineral sources and/or from renewable sources such as biomass (e.g. biomass-to-liquid sources) and/or from gas-to-liquid sources and/or from coal-to-liquid sources.

Oxygenate base fuels that may be used in a spark-ignition internal combustion engine contain oxygenate fuel components, such as alcohols and ethers. Suitable alcohols include straight and/or branched chain alkyl alcohols having from 1 to 6 carbon atoms, e.g. methanol, ethanol, n-propanol, n-butanol, isobutanol, tert-butanol. Preferred alcohols include methanol and ethanol, preferably ethanol. In some preferred embodiments, the fuel composition comprises ethanol, e.g. ethanol complying with EN 15376:2014. Suitable ethers include ethers having 5 or more carbon atoms, e.g. methyl tert-butyl ether and ethyl tert-butyl ether.

Where an oxygenate base fuel is used, the fuel composition may comprise oxygenates (i.e. from the oxygenate base fuel and the additised oxygenate) in an amount of up to 85%, preferably from 1% to 30%, more preferably from 3% to 20%, and even more preferably from 5% to 15%, by volume. For instance, the fuel may contain ethanol in an amount of about 5% by volume (i.e. an E5 fuel), about 10% by volume (i.e. an E10 fuel) or about 15% by volume (i.e. an E15 fuel). A fuel which is free from ethanol is referred to as an E0 fuel.

Fuel Composition

The fuel compositions disclosed herein are preferably used in a spark-ignition internal combustion engine. It will be appreciated that the fuel compositions may be used in engines other than spark-ignition internal combustion engines, provided that the fuel compositions are suitable for use in a spark-ignition internal combustion engine. Gasoline fuels (including those containing oxygenates) are typically used in spark-ignition internal combustion engines. Commensurately, the fuel composition according to the present invention may be a gasoline fuel composition.

The fuel composition may meet particular automotive industry standards. For instance, the fuel composition may have a maximum oxygen content of 2.7% by mass. The fuel composition may have maximum amounts of oxygenates as specified in EN 228, e.g. methanol: 3.0% by volume, ethanol: 5.0% by volume, iso-propanol: 10.0% by volume, iso-butyl alcohol: 10.0% by volume, tert-butanol: 7.0% by volume, ethers (e.g. having 5 or more carbon atoms): 10% by volume and other oxygenates (subject to suitable final boiling point): 10.0% by volume.

The fuel composition may have a sulfur content of up to 50.0 ppm by weight, e.g. up to 10.0 ppm by weight.

Examples of suitable fuel compositions include leaded and unleaded fuel compositions. Preferred fuel compositions are unleaded fuel compositions.

In embodiments, the fuel composition meets the requirements of EN 228, e.g. as set out in BS EN 228:2012. In other embodiments, the fuel composition meets the requirements of ASTM D 4814, e.g. as set out in ASTM D 4814-15a. It will be appreciated that the fuel compositions may meet both requirements, and/or other fuel standards.

The fuel composition for a spark-ignition internal combustion engine may exhibit one or more (such as all) of the following, e.g., as defined according to BS EN 228:2012: a minimum research octane number of 95.0, a minimum motor octane number of 85.0 a maximum lead content of 5.0 mg/1, a density of 720.0 to 775.0 kg/m$^3$, an oxidation stability of at least 360 minutes, a maximum existent gum content (solvent washed) of 5 mg/100 ml, a class 1 copper strip corrosion (3 h at 50° C.), clear and bright appearance, a maximum olefin content of 18.0% by weight, a maximum aromatics content of 35.0% by weight, and a maximum benzene content of 1.00% by volume.

In some embodiments, the method comprises adding at least one further fuel additive to the base fuel, preferably by adding the further fuel additive to the blend of additised oxygenate and base fuel e.g. using conventional additisation processes.

Examples of such other additives that may be introduced into the fuel compositions include detergents, friction modifiers/anti-wear additives, corrosion inhibitors, combustion modifiers, anti-oxidants, valve seat recession additives, dehazers/demulsifiers, dyes, markers, odorants, anti-static agents, anti-microbial agents, and lubricity improvers.

Further octane improvers may also be introduced into the fuel composition, e.g. octane improvers which are not octane-boosting additives described herein, i.e. they do not have a chemical structure comprising a 6-membered aromatic ring sharing two adjacent aromatic carbon atoms with a 6- or 7-membered saturated heterocyclic ring, the 6- or 7-membered saturated heterocyclic ring comprising a nitrogen atom directly bonded to one of the shared carbon atoms to form a secondary amine and an atom selected from oxygen or nitrogen directly bonded to the other shared carbon atom, the remaining atoms in the 6- or 7-membered heterocyclic ring being carbon.

Examples of suitable detergents include polyisobutylene amines (PIB amines) and polyether amines.

Examples of suitable friction modifiers and anti-wear additives include those that are ash-producing additives or ashless additives. Examples of friction modifiers and anti-wear additives include esters (e.g. glycerol mono-oleate) and fatty acids (e.g. oleic acid and stearic acid).

Examples of suitable corrosion inhibitors include ammonium salts of organic carboxylic acids, amines and heterocyclic aromatics, e.g. alkylamines, imidazolines and tolyltriazoles.

Examples of suitable anti-oxidants include phenolic anti-oxidants (e.g. 2,4-di-tert-butylphenol and 3,5-di-tert-butyl-4-hydroxyphenylpropionic acid) and aminic anti-oxidants (e.g. para-phenylenediamine, dicyclohexylamine and derivatives thereof).

Examples of suitable valve seat recession additives include inorganic salts of potassium or phosphorus.

Examples of suitable further octane improvers include non-metallic octane improvers include N-methyl aniline and nitrogen-based ashless octane improvers. Metal-containing octane improvers, including methylcyclopentadienyl manganese tricarbonyl, ferrocene and tetra-ethyl lead, may also be used. However, in preferred embodiments, the fuel composition is free of all added metallic octane improvers including methyl cyclopentadienyl manganese tricarbonyl and other metallic octane improvers including e.g ferrocene and tetraethyl lead.

Examples of suitable dehazers/demulsifiers include phenolic resins, esters, polyamines, sulfonates or alcohols which are grafted onto polyethylene or polypropylene glycols.

Examples of suitable markers and dyes include azo or anthraquinone derivatives.

Examples of suitable anti-static agents include fuel soluble chromium metals, polymeric sulfur and nitrogen compounds, quaternary ammonium salts or complex organic alcohols. However, the fuel composition is preferably substantially free from all polymeric sulfur and all metallic additives, including chromium based compounds.

In some embodiments, the solvent, e.g. which has been used to ensure that the additives are in a form in which they can be stored or combined with the liquid fuel, is introduced into the fuel composition. Examples of suitable solvents include polyethers and aromatic and/or aliphatic hydrocarbons, e.g. heavy naphtha e.g. Solvesso (Trade mark), xylenes and kerosene.

Representative typical and more typical independent amounts of additives (if present) and solvent that may be introduced into the fuel composition are given in the table below. For the additives, the concentrations are expressed by weight (of the base fuel) of active additive compounds, i.e. independent of any solvent or diluent. Where more than one additive of each type is present in the fuel composition, the total amount of each type of additive is expressed in the table below.

| | Fuel Composition | |
|---|---|---|
| | Typical amount (ppm, by weight) | More typical amount (ppm, by weight) |
| Octane-boosting additives | 1000 to 100000 | 2000 to 50000 |
| Detergents | 10 to 2000 | 50 to 300 |
| Friction modifiers and anti-wear additives | 10 to 500 | 25 to 150 |
| Corrosion inhibitors | 0.1 to 100 | 0.5 to 40 |
| Anti-oxidants | 1 to 100 | 10 to 50 |
| Further octane improvers | 0 to 20000 | 50 to 10000 |

-continued

| | Fuel Composition | |
|---|---|---|
| | Typical amount (ppm, by weight) | More typical amount (ppm, by weight) |
| Dehazers and demulsifiers | 0.05 to 30 | 0.1 to 10 |
| Anti-static agents | 0.1 to 5 | 0.5 to 2 |
| Other additive components | 0 to 500 | 0 to 200 |
| Solvent | 10 to 3000 | 50 to 1000 |

In some embodiments, the fuel composition comprises or consists of additives and solvents in the typical or more typical amounts recited in the table above.

In embodiments in which the fuel composition comprises one or more further fuel additives, the further fuel additives may also be combined, in one or more steps, with the fuel.

In some embodiments, the one or more further fuel additives may be combined with the fuel in the form of a refinery additive composition or as a marketing additive composition. Thus, the one or more further fuel additives may be combined with one or more other components (e.g. additives and/or solvents) of the fuel composition as a marketing additive, e.g. at a terminal or distribution point. A further fuel additive may also be added on its own at a terminal or distribution point. The one or more further fuel additives may also be combined with one or more other components (e.g. additives and/or solvents) of the fuel composition for sale in a bottle, e.g. for addition to fuel at a later time.

The one or more further fuel additives and any other additives of the fuel composition may be incorporated into the fuel composition as one or more additive concentrates and/or additive part packs, optionally comprising solvent or diluent.

Uses and Methods

The fuel compositions disclosed herein may be used in a spark-ignition internal combustion engine. Examples of spark-ignition internal combustion engines include direct injection spark-ignition engines and port fuel injection spark-ignition engines. The spark-ignition internal combustion engine may be used in automotive applications, e.g. in a vehicle such as a passenger car.

Examples of suitable direct injection spark-ignition internal combustion engines include boosted direct injection spark-ignition internal combustion engines, e.g. turbocharged boosted direct injection engines and supercharged boosted direct injection engines. Suitable engines include 2.0 L boosted direct injection spark-ignition internal combustion engines. Suitable direct injection engines include those that have side mounted direct injectors and/or centrally mounted direct injectors.

Examples of suitable port fuel injection spark-ignition internal combustion engines include any suitable port fuel injection spark-ignition internal combustion engine including e.g. a BMW 318i engine, a Ford 2.3 L Ranger engine and an MB M111 engine.

The fuel compositions disclosed herein, e.g. those containing octane-boosting additives disclosed herein, may be used to increase the octane number of a fuel for a spark-ignition internal combustion engine. In some embodiments, the octane-boosting additives increase the RON or the MON of the fuel. In preferred embodiments, the octane-boosting additives increase the RON of the fuel, and more preferably the RON and MON of the fuel. The RON and MON of the fuel may be tested according to ASTM D2699-15a and ASTM D2700-13, respectively.

Since the octane-boosting additives described herein increase the octane number of a fuel for a spark-ignition internal combustion engine, they may also be used to address abnormal combustion that may arise as a result of a lower than desirable octane number. Thus, the fuel compositions disclosed herein, e.g. those containing octane-boosting additives disclosed herein, may be used for improving the auto-ignition characteristics of a fuel, e.g. by reducing the propensity of a fuel for at least one of auto-ignition, pre-ignition, knock, mega-knock and super-knock, when used in a spark-ignition internal combustion engine.

Also contemplated is a method for increasing the octane number of a fuel for a spark-ignition internal combustion engine, as well as a method for improving the auto-ignition characteristics of a fuel, e.g. by reducing the propensity of a fuel for at least one of auto-ignition, pre-ignition, knock, mega-knock and super-knock, when used in a spark-ignition internal combustion engine. These methods comprise the step of blending an octane-boosting additive described herein with the fuel.

The methods described herein may further comprise delivering the blended fuel to a spark-ignition internal combustion engine and/or operating the spark-ignition internal combustion engine.

The present invention will now be described with reference to the accompanying figure and non-limiting examples.

FIG. 1 shows an apparatus (10) in accordance with the present invention. The apparatus comprises a base fuel source (12), an oxygenate source (14) and an octane-boosting additive source (16). The base fuel source (12), oxygenate source (14) and octane-boosting additive source (16) are shown in the figure as storage tanks, though it will be appreciated that these components may e.g. be provided directly from pipelines.

An oxygenate is passed from the oxygenate source (14) through an oxygenate feed line (22) to an additive blending point (30). An octane-boosting additive is passed from the octane-boosting additive source (14) through an octane-boosting additive feed line (24) to the additive blending point (30). At the additive blending point (30), the oxygenate and the octane-boosting additive are blended to form an additised oxygenate.

A base fuel is passed from the base fuel source (12) to a fuel blending point (32). The additised oxygenate is passed through a line (26) to the fuel blending point (32), via a mixing device (34). At the fuel blending point (32), the additised oxygenate and the base fuel are blended to form a fuel composition. The fuel composition is passed through a line (28) to a fuel composition distribution station (18), via a mixing valve (36).

In some embodiments of the present invention, line (24') may be used (as is typical in the prior art) to introduce conventional deposit-control fuel additives into the fuel composition. It can be seen that, the deposit-control fuel additives pass directly from the deposit-control fuel additive source (16') via a line (24') to a fuel blending point (32'). Thus, the octane-boosting additive blending system of the present invention may be used to supplement a conventional deposit-control additive blending system.

EXAMPLES

Example 1: Preparation of Octane-Boosting Additives

The following octane-boosting additives were prepared using standard methods:

OX1

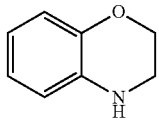

OX2

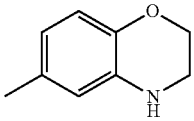

OX3

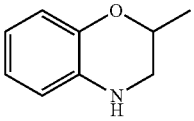

OX4

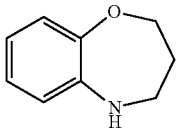

OX5

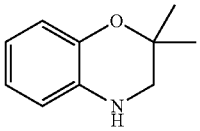

OX6

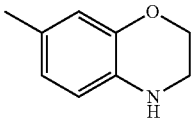

OX7

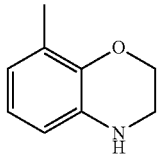

OX8

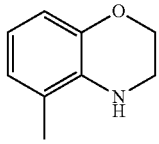

OX9

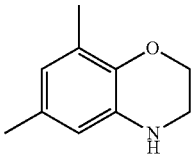

OX10

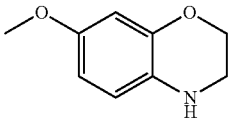

OX11

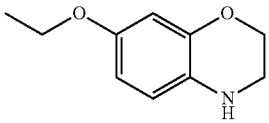

-continued

OX12

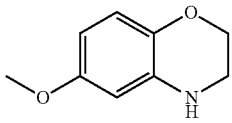

OX13

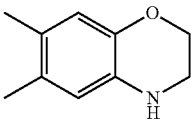

OX14

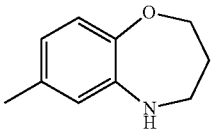

OX15

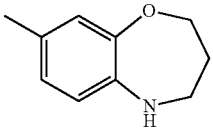

OX16

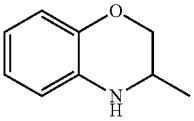

OX17

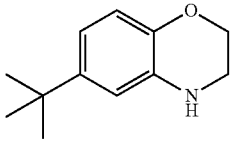

OX18

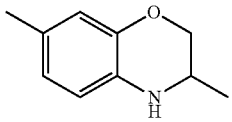

OX19

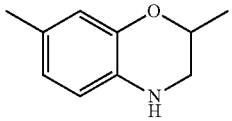

Example 2: Octane Number of Oxygenate Fuels Containing Octane-Boosting Additives The effect of octane-boosting additives from Example 1 (OX1, OX2, OX3, OX5, OX6, OX8, OX9, OX12, OX13, OX17 and OX19) on the octane number of an oxygenate base fuel for a spark-ignition internal combustion engine was measured.

The additives were added to the fuel at a relatively low treat rate of 0.67% weight additive/weight base fuel, equivalent to a treat rate of 5 g additive/litre of fuel. The fuel was an E10 gasoline base fuel. The RON and MON of the base fuel, as well as the blends of base fuel and octane-boosting additive, were determined according to ASTM D2699 and ASTM D2700, respectively.

The following table shows the RON and MON of the fuel and the blends of fuel and octane-boosting additive, as well as the change in the RON and MON that was brought about by using the octane-boosting additives:

| Additive | E10 base fuel RON | MON | Δ RON | Δ MON |
|---|---|---|---|---|
| — | 95.4 | 85.2 | n/a | n/a |
| OX1 | 97.3 | 86.3 | 1.9 | 1.1 |
| OX2 | 97.8 | 86.5 | 2.4 | 1.3 |
| OX3 | 97.1 | 85.5 | 1.7 | 0.3 |
| OX5 | 97.1 | 85.5 | 1.7 | 0.3 |
| OX6 | 98.0 | 86.8 | 2.6 | 1.6 |
| OX8 | 96.9 | 85.7 | 1.5 | 0.5 |
| OX9 | 97.6 | 86.5 | 2.2 | 1.3 |
| OX12 | 97.3 | 86.1 | 1.9 | 0.9 |
| OX13 | 97.7 | 86.1 | 2.3 | 0.9 |
| OX17 | 97.4 | 86.4 | 2.0 | 1.2 |
| OX19 | 97.6 | 85.9 | 2.2 | 0.7 |

It can be seen that the octane-boosting additives may be used to increase the RON of an oxygenate fuel for a spark-ignition internal combustion engine.

Further additives from Example 1 (OX4, OX10, OX11, OX14, OX15, OX16 and OX18) were tested in the E10 gasoline base fuel. Each of the additives increased the RON of the fuel.

Example 3: Variation of Octane Number with Octane-Boosting Additive Treat Rate The effect of an octane-boosting additive from Example 1 (OX6) on the octane number of an oxygenate fuel for a spark-ignition internal combustion engine was measured over a range of treat rates (% weight additive/weight base fuel).

The fuel was an E10 gasoline base fuel. As before, the RON and MON of the base fuel, as well as the blends of base fuel and octane-boosting additive, were determined according to ASTM D2699 and ASTM D2700, respectively.

The following table shows the RON and MON of the fuel and the blends of fuel and octane-boosting additive, as well as the change in the RON and MON that was brought about by using the octane-boosting additive:

| | Additive treat rate (% w/w) | Octane number RON | MON | Δ RON | Δ MON |
|---|---|---|---|---|---|
| E10 95 RON | 0.00 | 95.4 | 85.1 | 0.0 | 0.0 |
| | 0.10 | 95.9 | 85.2 | 0.5 | 0.1 |
| | 0.20 | 96.3 | 86.3 | 0.9 | 1.2 |
| | 0.30 | 96.8 | 86.3 | 1.4 | 1.2 |
| | 0.40 | 96.9 | 85.8 | 1.5 | 0.7 |
| | 0.50 | 97.3 | 85.9 | 1.9 | 0.8 |
| | 0.60 | 97.4 | 85.9 | 2.0 | 0.8 |
| | 0.70 | 97.9 | 86.0 | 2.5 | 0.9 |
| | 0.80 | 98.2 | 86.8 | 2.8 | 1.7 |
| | 0.90 | 98.7 | 86.3 | 3.3 | 1.2 |
| | 1.00 | 98.8 | 86.5 | 3.4 | 1.4 |
| | 10.00 | 105.1 | 87.8 | 9.7 | 2.7 |

Figure 2:
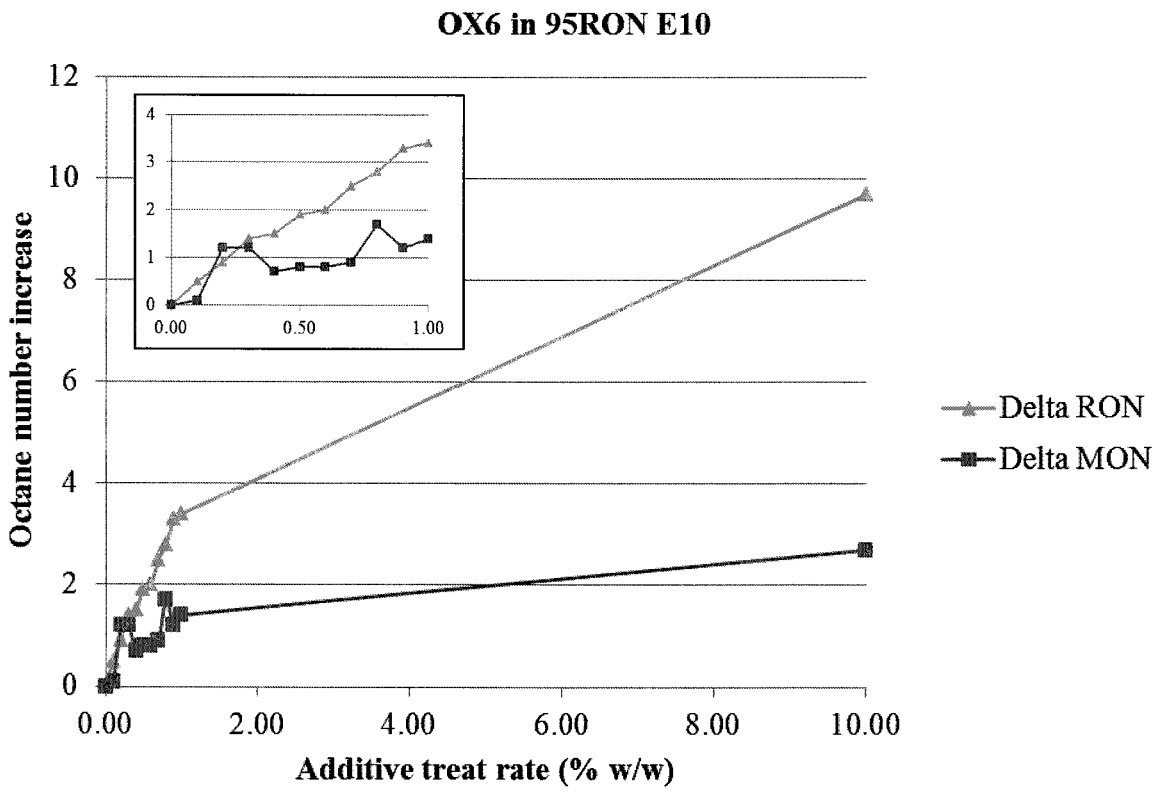
FIG. 2 shows a graph of the change in octane number (both RON and MON) of an E10 gasoline base fuel having a RON of 95 when treated with varying amounts of an octane-boosting additive described herein.

A graph of the effect of the octane-boosting additive on the RON and MON of the fuel is shown in FIG. 2. It can be seen that the octane-boosting additive had a significant effect on the octane numbers of the fuel, even at very low treat rates.

Example 4: Comparison of Octane-Boosting Additive with N-Methyl Aniline

The effect of octane-boosting additives from Example 1 (OX2 and OX6) was compared with the effect of N-methyl aniline on the octane number of an E10 gasoline base fuel for a spark-ignition internal combustion engine over a range of treat rates (% weight additive/weight base fuel).

As before, the RON and MON of the base fuels, as well as the blends of base fuel and octane-boosting additive, were determined according to ASTM D2699 and ASTM D2700, respectively.

Figure 3A:
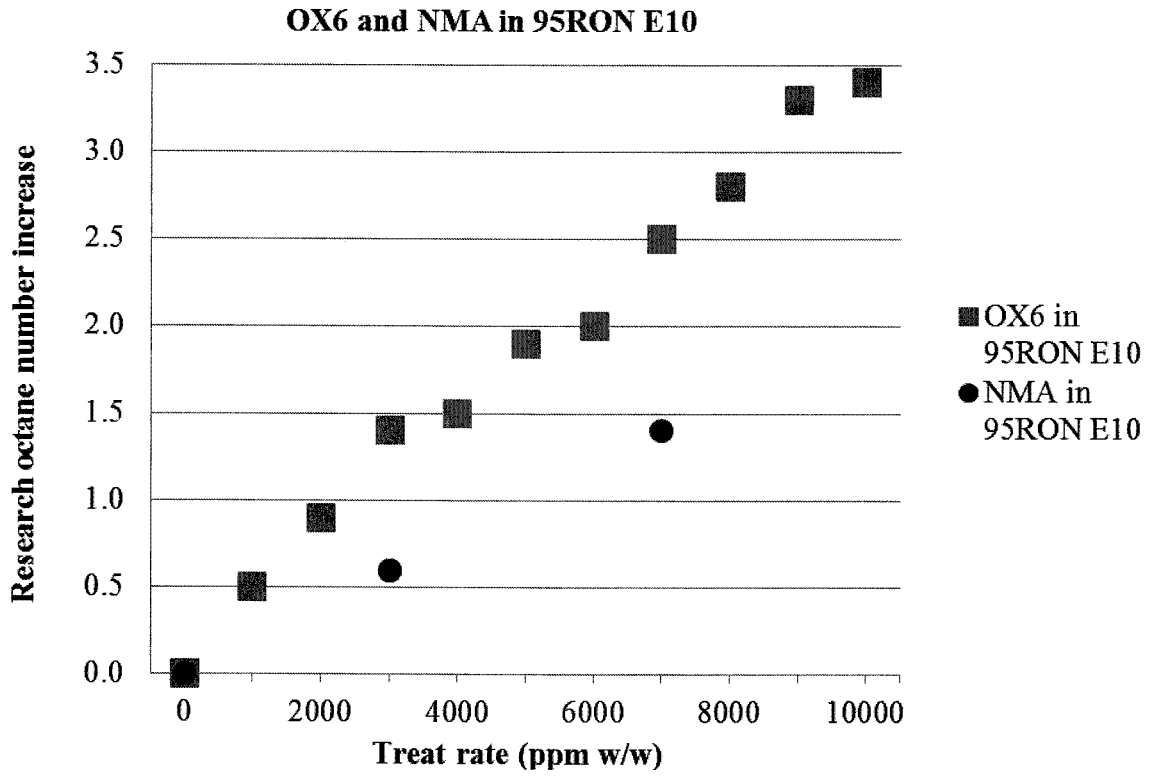
FIGS. 3*a* and 3*b* show graphs comparing the change in octane number (both RON and MON) of oxygenate fuels when treated with octane-boosting additives described herein and N-methyl aniline. Specifically.

A graph of the change in octane number of the E10 fuel against treat rate of N-methyl aniline and an octane-boosting additive (OX6) is shown in FIG. 3*a*. The treat rates are typical of those used in a fuel. It can be seen from the graph that the performance of the octane-boosting additives described herein is significantly better than that of N-methyl aniline across the treat rates.

Figure 3B:
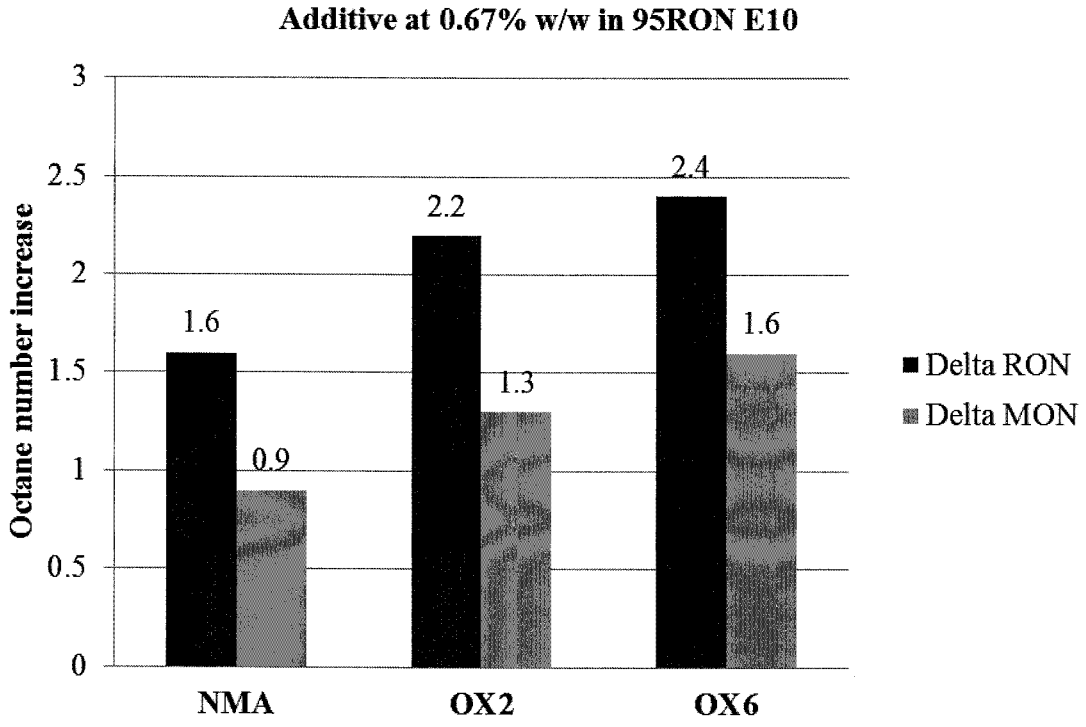

A comparison of the effect of two octane-boosting additives (OX2 and OX6) and N-methyl aniline on the octane number of the E10 fuel at a treat rate of 0.67% w/w is shown in FIG. 3*b*. It can be seen from the graph that the performance of octane-boosting additives described herein is significantly superior to that of N-methyl aniline.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope and spirit of this invention

The invention claimed is:

1. A method for preparing at least two fuel compositions, each fuel composition independently comprises a base fuel in an amount greater than 50% by weight, an oxygenate and an octane-boosting additive, said method comprising:

blending the octane-boosting additive with an oxygenate to produce a first additised oxygenate, and blending the first additised oxygenate with a base fuel to produce a first fuel composition; and blending the octane-boosting additive with the oxygenate to produce a second additised oxygenate, and blending the second additised oxygenate with the base fuel to produce a second fuel composition;

wherein the first and second fuel compositions comprise the same amount of oxygenate but have a different octane number, or the first and second fuel compositions comprise a different amount of oxygenate but have the same octane number, and wherein the oxygenate is present in the fuel composition in an amount of from 1% to 30% by volume.

2. A method according to claim 1, wherein blending the octane-boosting additive with the oxygenate is by adding the octane-boosting additive to an oxygenate storage tank or to an oxygenate stream which leads to a fuel blending point through which the additised oxygenate may be blended with the base fuel.

3. A method according to claim 1, wherein the method further comprises:

adding a further fuel additive to the base fuel.

4. A method according to claim 1, wherein the method comprises at least one of:

passing the additised oxygenate through a mixing device, and passing the fuel composition through a mixing device.

5. A method according to claim 1, wherein the oxygenate is an alcohol or an ether.

6. A method according to claim 1, wherein the oxygenate is present in the fuel composition in an amount of from 3% to 20% by volume.

7. A method according to claim 1, wherein the octane-boosting additive is a non-metallic octane-boosting additive.

8. A method according to claim 7, wherein the octane-boosting additive has a formula:

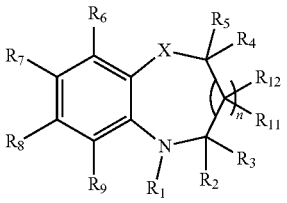

where: $R_1$ is hydrogen;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1.

9. A method according to claim 1, wherein the fuel composition comprises the octane-boosting additive in an amount of up to 20% by weight.

10. A method according to claim 1, wherein the base fuel is a hydrocarbon base fuel.

11. A method according to claim 1, wherein blending the octane-boosting additive with the oxygenate is by adding the octane-boosting additive to an oxygenate stream which leads to a fuel blending point through which the additised oxygenate may be blended with the base fuel.

12. A method according to claim 1, wherein the method further comprises adding a further fuel additive to the blend of additised oxygenate and base fuel.

13. A method according to claim 1, wherein the oxygenate is a mono-alcohol or a mono-ether with a final boiling point of up to 225° C.

14. A method according to claim 1, wherein the oxygenate is methanol, ethanol or butanol.

15. A method for preparing a fuel composition which comprises a base fuel in an amount greater than 50% by weight, an oxygenate and an octane-boosting additive, wherein the oxygenate is present in the fuel composition in an amount of from 1% to 30% by volume, and wherein the octane-boosting additive has a formula:

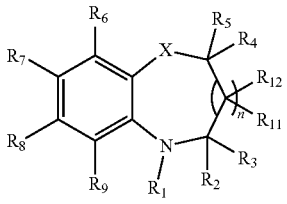

where: $R_1$ is hydrogen;

$R_2$, $R_3$, $R_4$, $R_5$, $R_{11}$ and $R_{12}$ are each independently selected from hydrogen, alkyl, alkoxy, alkoxy-alkyl, secondary amine and tertiary amine groups;

$R_6$, $R_7$, $R_8$ and $R_9$ are each independently selected from hydrogen, alkyl, alkoxy, alkoxy-alkyl, secondary amine and tertiary amine groups;

X is selected from —O— or —$NR_{10}$—, where $R_{10}$ is selected from hydrogen and alkyl groups; and n is 0 or 1, said method comprising:

blending an additised oxygenate comprising the oxygenate and the octane-boosting additive with a base fuel.

16. A method according to claim 15, wherein the method further comprises: producing the additised oxygenate by blending the octane-boosting additive with the oxygenate.

17. A method according to claim 15, wherein the method further comprises: adding a further fuel additive to the base fuel.

18. A method according to claim 15, wherein the method further comprises adding a further fuel additive to the blend of additised oxygenate and base fuel.

19. A method according to claim 15, wherein the oxygenate is present in the fuel composition in an amount of from 3% to 20% by volume.

20. A method according to claim 15, wherein the oxygenate is methanol, ethanol or butanol.

* * * * *